US006352431B1

(12) United States Patent
Gatley, Jr.

(10) Patent No.: US 6,352,431 B1
(45) Date of Patent: Mar. 5, 2002

(54) FURNACE INDUCER MOTOR COOLING SYSTEM

(75) Inventor: William Stuart Gatley, Jr., Cassville, MO (US)

(73) Assignee: Jakel Incorporated, Highland, IL (US)

( * ) Notice: Subject to any disclaimer, the term of this patent is extended or adjusted under 35 U.S.C. 154(b) by 0 days.

(21) Appl. No.: 09/705,172

(22) Filed: Nov. 2, 2000

Related U.S. Application Data

(63) Continuation-in-part of application No. 09/631,925, filed on Aug. 3, 2000.

(51) Int. Cl.[7] ..... F27D 15/02

(52) U.S. Cl. ..... 432/77; 432/145; 432/233; 126/104 A; 126/110 A

(58) Field of Search ..... 432/77, 116, 145, 432/173, 233; 310/52; 126/110 A, 104 A, 110 E, 110 C, 116 C

(56) References Cited

U.S. PATENT DOCUMENTS 4,626,720 A 12/1986 Fukasaku et al.
4,651,711 A * 3/1987 Velie ..... 126/110 C
4,848,313 A * 7/1989 Velie ..... 126/110 C
4,906,182 A 3/1990 Moller
5,201,024 A 4/1993 Steffes
5,313,930 A 5/1994 Kujawa et al.
5,341,795 A 8/1994 Chou et al.
5,347,980 A 9/1994 Shellenberger
5,368,010 A 11/1994 Weber, III et al.
5,477,846 A 12/1995 Cameron
5,775,318 A 7/1998 Haydock et al.
5,834,869 A 11/1998 Morgan et al.
6,021,775 A 2/2000 Dempsey et al.
6,216,685 B1 4/2001 Payne
6,231,311 B1 5/2001 Gatley et al.

* cited by examiner

*Primary Examiner*—Gregory Wilson
(74) *Attorney, Agent, or Firm*—Howell & Haferkamp LC

(57) ABSTRACT

A furnace includes a main blower housed in an inlet plenum that circulates temperature controlled air through the furnace and an inducer fan that circulates combustion gases through the furnace. The inducer fan is driven by an inducer fan motor with a housing that defines a hollow interior and surrounds the motor. The inducer fan motor housing is in communication with the inlet plenum and operation of the main blower draws cooling air through the interior of the motor housing to cool the motor.

20 Claims, 6 Drawing Sheets

FURNACE INDUCER MOTOR COOLING SYSTEM

RELATED U.S. APPLICATION DATA

This application is a continuation-in-part of application Ser. No. 09/631,925, filed Aug. 3, 2000.

BACKGROUND OF THE INVENTION (i) Field of the Invention

This invention relates generally to furnaces and particularly to cooling a motor that drives a draft inducing fan in a furnace. The invention provides for an improved method of cooling the motor that drives the inducer fan and an apparatus for practicing the method.

(ii) Description of the Related Art

Typically, a household furnace includes an inducer fan and motor that draw a flow of air through a combustion chamber and then a heat exchanger of the furnace before exhausting the combustion gases from the furnace, and a blower fan and motor that draw a flow of air into the furnace and blow the flow of air across the heat exchanger to heat the air and then deliver the heated air to the conduit system that directs the heated air through the household.

In typical prior art furnaces, the fan motor is located in the vestibule of the furnace which also houses the electronics and controls for controlling the furnace. The heat generated by the blower motor elevates the temperature within the vestibule. The elevated temperature within the vestibule can shorten the life of the electronics and controls located within the vestibule. Additionally, the excess heat generated by the motor can shorten the life of the motor itself.

Typical prior art furnace fans utilize a motor that has an auxiliary fan attached to the rotating shaft of the motor to cool the motor. The auxiliary fan forces a flow of air across the motor to dissipate the heat generated by the motor. An auxiliary fan, however, has many disadvantages.

One disadvantage is that the auxiliary fan increases the size or height of the motor assembly thereby preventing the streamlining of the motor assembly and the associated furnace within which the motor assembly is used. Another disadvantage is that the use of an auxiliary fan produces an additional load on the motor which can reduce the overall motor efficiency and increase the energy consumption of the furnace in which is it used. Furthermore, the use of an auxiliary fan increases the cost of manufacturing the draft inducing fan. Another disadvantage is that the auxiliary fan can generate additional noise which may require the furnace within which it is used to incorporate additional sound deadening techniques. Finally, because the motor is typically used in a vestibule, the airflow of the auxiliary fan is channeled into the vestibule thereby contributing to the elevated temperature of the vestibule and the associated components residing therein.

Therefore, it is an object of the present invention to provide an apparatus and method for cooling the motor that eliminates the need for an auxiliary fan.

SUMMARY OF THE INVENTION

The present invention overcomes shortcomings of prior art furnaces that use an auxiliary fan attached to the motor to cool the motor driving the draft inducing fan by providing a furnace that cools the motor with the flow of air induced by the draft inducing fan. By eliminating the need for an auxiliary fan, the present invention allows for the motor and fan assembly to be more compact and streamlined than the prior art motor, fan and auxiliary fan assemblies. Additionally, the present invention reduces the overall cost of providing a means to cool the motor while reducing the noise associated with cooling the motor with only a minimal load being placed on the motor.

In general, the furnace of the present invention is comprised of a motor which resides in a housing having at least one inlet and at least one outlet. A fan is driven by the motor and resides in a fan housing. The fan housing is operatively connected to and communicates with the motor housing and is configured and adapted to cause a flow of air to flow through the motor housing prior to entering the fan housing, thereby cooling the motor.

More specifically, the furnace is comprised of a motor in a motor housing having at least one inlet and at least one outlet. A combustion chamber has at least one inlet and an outlet with the at least one combustion chamber inlet being operatively connected to and communicating with the at least one motor housing outlet. A heat exchanger has an inlet and an outlet with the heat exchanger inlet being operatively connected to and communicating with the combustion chamber outlet. A fan driven by the motor resides in a fan housing and the fan housing has an inlet and an outlet. The heat exchanger outlet is operatively connected to and communicates with the fan housing inlet. The fan causes a flow of air to flow into the motor housing through the at least one motor housing inlet, around the motor, and exit the motor housing through the at least one motor housing outlet. The flow of air then flows into the combustion chamber through the at least one combustion chamber inlet, through the combustion chamber, and exits the combustion chamber through the combustion chamber outlet. The flow of air then flows into the heat exchanger through the heat exchanger inlet, through the heat exchanger, and exits the heat exchanger through the heat exchanger outlet. The flow of air then flows into the fan housing through the fan housing inlet and exits the fan housing through the fan housing outlet. The flow of air cools the motor as it flows through the motor housing and around the motor without the need for an auxiliary fan.

In another embodiment of the invention, the furnace is provided with a main blower in an inlet plenum of the furnace for circulating temperature controlled air through the furnace and an inducer fan for circulating combustion gases through the furnace that heat the circulated temperature controlled air. The inducer motor for driving the inducer fan is provided with a motor housing that defines a hollow interior of the motor housing that surrounds the motor. The motor housing is placed in communication with the inlet plenum. During operation of the main blower, cooling air is drawn through the interior of the inducer fan motor housing and into the inlet plenum of the furnace. The flow of air cools the inducer motor as it flows through the motor housing and around the motor without the need for an auxiliary fan on the inducer motor.

BRIEF DESCRIPTION OF THE DRAWINGS

Further objectives and features of the present invention are set forth in the following detailed description of the preferred embodiment of the invention and in the drawing figures wherein.

DETAILED DESCRIPTION OF THE INVENTION

Figure 1A:
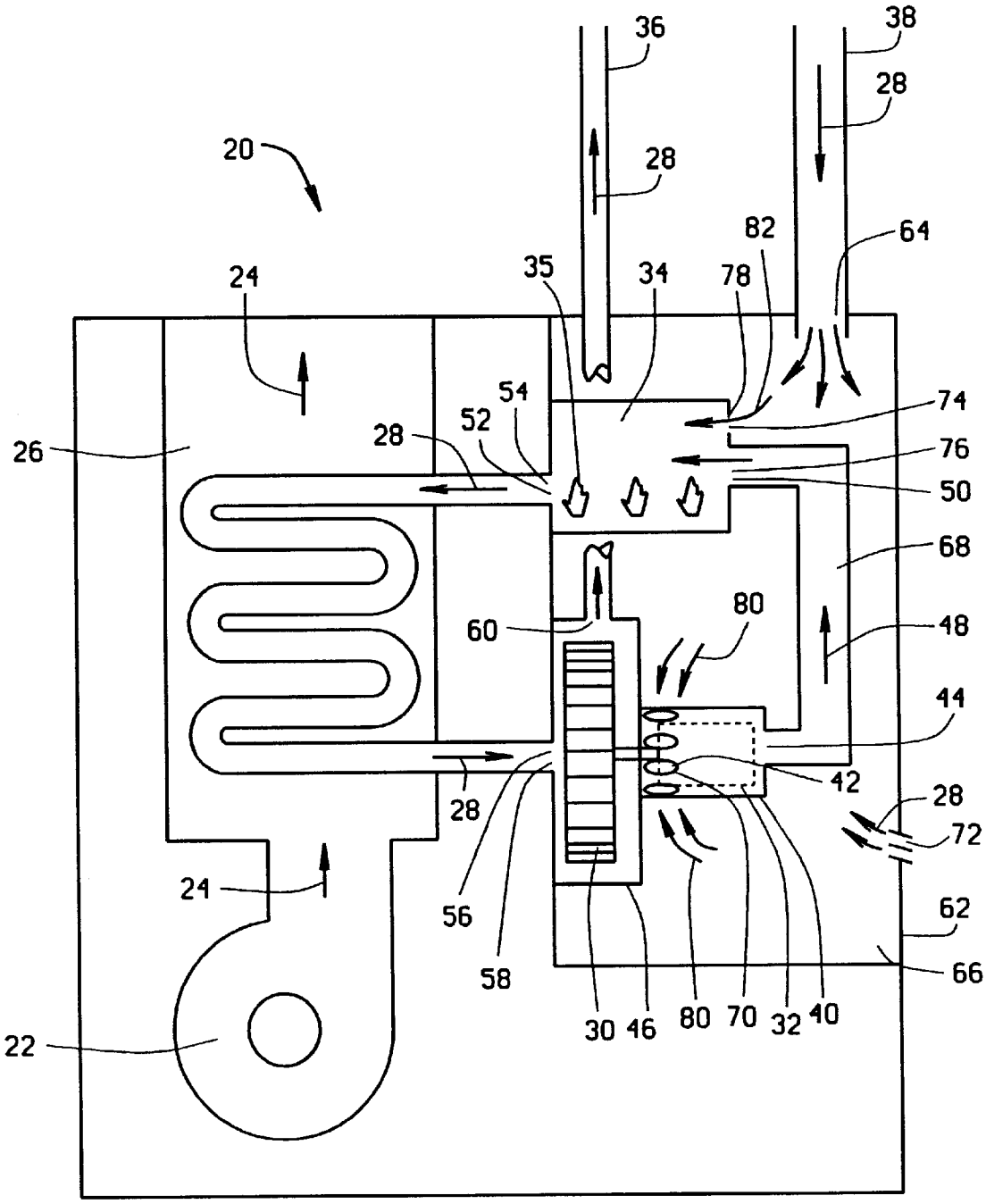
FIG. 1A is schematic drawing of a traditional furnace employing one embodiment of the present invention to cool the motor driving the fan.
Figure 1B:
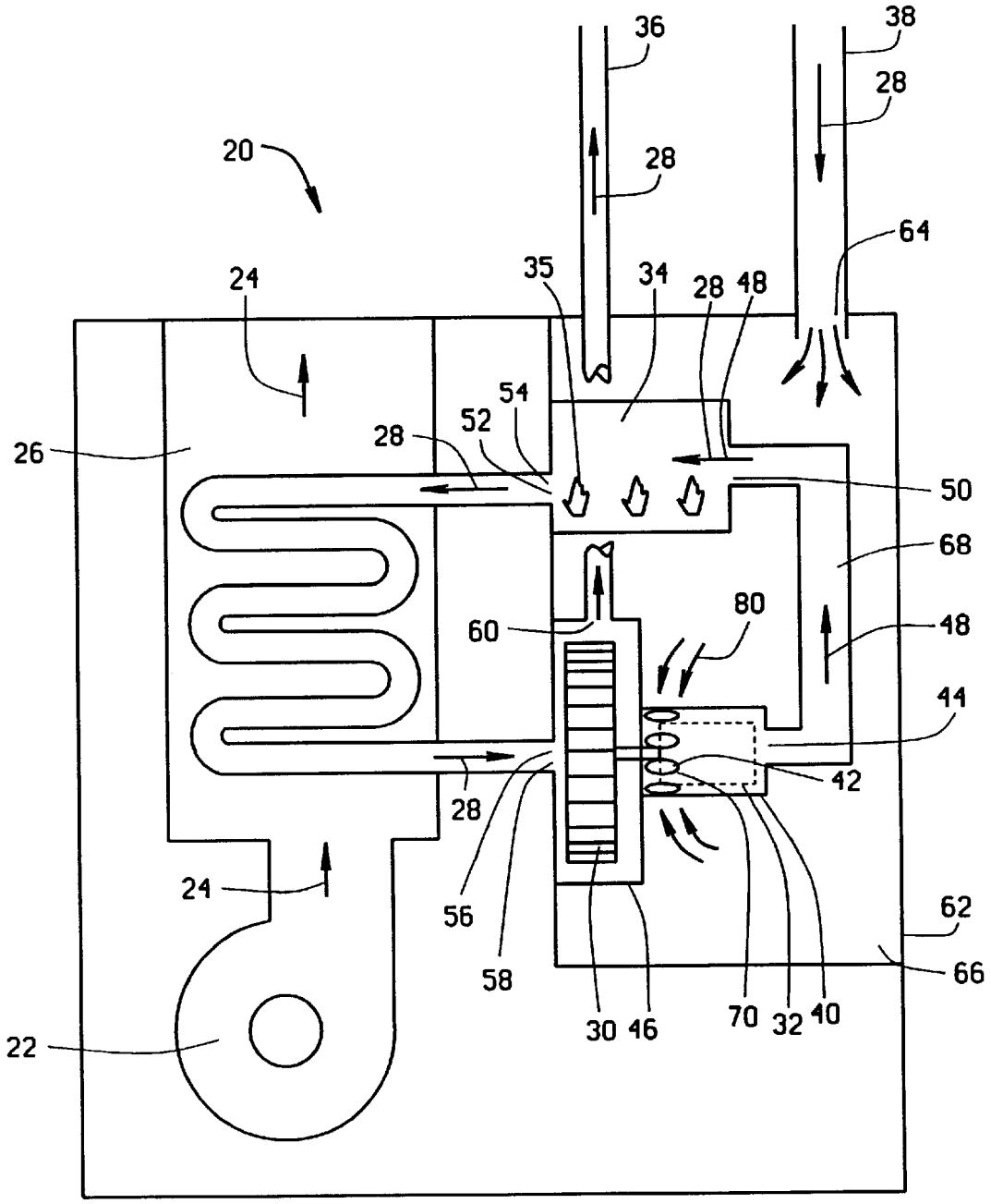
FIG. 1B is a schematic drawing of the furnace of FIG. 1A wherein the combustion chamber has a single inlet and the vestibule chamber has a plurality of inlets.

The furnace, as can be seen in FIG. 1A and generally indicated as 20, is basically comprised of a blower 22 which draws a flow of air 24 from the exterior environment and draws the flow of air 24 through a heat exchanger 26 wherein the flow of air 24 is heated and flows out of the heat exchanger and back into the environment which is to be heated by the furnace 20. The furnace 20 heats the flow of air 24 in the heat exchanger 26 by drawing a flow of combustion heated air 28 through the heat exchanger 26. The flow of combustion heated air 28 is drawn through the heat exchanger 26 by a fan 30 which is driven by a motor 32. The flow of air 28 is heated in a combustion chamber 34 by burners 35 or the like, as is well known in the industry, prior to be drawn through the heat exchanger 26. The flow of combustion air 28 is drawn into the fan 30 and exhausted through an exhaust pipe 36. In the case of a high efficiency furnace, the air being drawn into the combustion chamber 34 originates from outside the furnace 20 and can be in the room environment or outside the environment which is to be heated and is drawn into the furnace through the inlet pipe 38. Although, it should be understood that while the exhaust and inlet pipes 36, 38 have been described as pipes they can be part of a chimney or other air channeling structures as are well known in the industry.

Preferably, the motor 32 resides in a housing 40 having at least one inlet 42 and at least one outlet 44. The fan 30 which is driven by the motor 32 resides in a fan housing 46 and is operatively connected to and communicates with the at least one motor housing outlet 44 and is configured and adapted to cause a flow of air 48 to flow through the motor housing 40 prior to flowing through the fan housing 46. The flow of air 48 thereby cools the motor 32 as it flows through the motor housing 40 and around the motor 32.

Preferably, the combustion chamber 34 has at least one inlet 50 and an outlet 52. The at least one combustion chamber inlet 50 is operatively connected to and communicates with the at least one motor housing outlet 44 so that the flow of air 48 through the motor housing 40 flows through the combustion chamber 34 prior to flowing into the fan housing 46. The heat exchanger 36 has an inlet 54 and an outlet 56. The heat exchanger inlet 54 is operatively connected to and communicates with the combustion chamber outlet 52 and the heat exchanger outlet 56 is operatively connected to and communicates with the fan housing 46. The flow of air 48 through the combustion chamber 34 flows through the heat exchanger 26 prior to flowing into the fan housing 46. The fan housing 46 has an inlet 58 and an outlet 60. The fan housing inlet 58 is operatively connected to and communicates with the heat exchanger outlet 56 and the fan housing outlet 60 is operatively connected to and communicates with the exhaust pipe 36. The fan 30 causes the flow of air 48 to enter the motor housing 40 through the at least one motor housing inlet 42, flow around the motor 32 and through the motor housing 40, and then exit the motor housing 40 through the at least one motor housing outlet 44. The flow of air 48 then flows into the combustion chamber 34 through the at least one combustion chamber inlet 50 and through the combustion chamber 34 where it mixes with the furnace fuel and is heated by combustion, and then exits the combustion chamber 34 through the combustion chamber outlet 52. The flow of combustion heated air 48 then flows into the heat exchanger 26 through the heat exchanger inlet 54 and through the heat exchanger 26, and then exits the heat exchanger 26 through the heat exchanger outlet 56. The flow of combustion heated air 48 then flows into the fan housing 46 through the fan housing inlet 58 and through the fan housing 46, and then exits the fan housing 46 through the fan housing outlet 60. The flow of air 48 then exits the furnace 20 through the exhaust pipe 36. The flow of air 48 thereby cools the motor 32 as it flows through the motor housing 40 and around the motor 42.

Preferably, the furnace 20 also has a vestibule chamber 62 which has at least one inlet 64. The motor 32 and the motor housing 46 reside in an interior 66 of the vestibule chamber 62. In a typical furnace, the vestibule chamber interior 66 also contains the electronics and controls (not shown) to control the operation of the furnace 20. The flow of air 28 being drawn into the furnace 20 by the fan 30 flows through the at least one vestibule chamber inlet 64 prior to flowing through the combustion chamber 34.

In a preferred embodiment, as can be seen in FIGS. 1A and B, the at least one motor housing outlet 44 is connected to and communicates with the at least one combustion chamber inlet 50 by an air passageway 68. The air passageway 68 channels the flow of air 48 from the at least one motor housing outlet 44 to the at least one combustion chamber inlet 50. The flow of air 48 flowing through the motor housing 40 flows through the vestibule chamber interior 66 prior to flowing into the motor housing 40. The flow of air 48 thereby cooling the electronics and controls (not shown) and any other components that reside in the vestibule chamber interior 66 along with cooling the motor 32.

In one aspect of the preferred embodiment, the at least one motor housing inlet 42 is one of a plurality of motor housing inlets 70 and the at least one vestibule chamber inlet 64 is one of a plurality of vestibule chamber inlets 72. The flow of air 28 being drawn into the furnace 20 by the fan 30 flows through the plurality of vestibule chamber inlets 72 and into the vestibule chamber interior 66. The flow of air 48 that flows through the motor housing 40 flows from the vestibule chamber interior 66 and into the motor housing 40 through the plurality of motor housing inlets 70.

In another aspect of the preferred embodiment, the combustion chamber 34 is sealed, as shown in FIG. I B, and all the air flowing through the combustion chamber 34 flows through the air passageway 68 prior to flowing into the combustion chamber 34. Because the combustion chamber 34 is sealed, the flow of air 28 being drawn into the furnace 20 by the fan 30 is the same flow of air 48 that is flowing through the motor housing 40. The flow of air 28 enters the vestibule chamber interior 66 through the at least one vestibule chamber inlet 64 and flows into the motor housing 40 through the at least one motor housing inlet 42. The flow of air 28 then flows through the motor housing 40 and into the air passageway 68 through the at least one motor housing outlet 44. The flow of air 28 then flows through the air passageway 68 and into the combustion chamber 34 through the at least one combustion chamber inlet 50, which is connected to the air passageway 68 and exits the combustion chamber 34 through the combustion chamber outlet 52. The flow of air 28 then flows through the heat exchanger 26 and the fan housing 46 as previously discussed. Because all of the air being drawn into the furnace 20 by the fan 30 flows through the motor housing 40, a maximum amount of air flows through the motor housing 40 and a maximum amount of cooling is achieved.

In yet another aspect of the preferred embodiment, as can been seen in FIG. 1A, the at least one combustion chamber inlet 50 is one of a plurality of combustion chamber inlets. The plurality of combustion chamber inlets include a main combustion chamber inlet 76 and secondary combustion chamber inlet 78. The main combustion chamber inlet 78 is connected to and communicates with the air passageway 68 so that the flow of air 48 flowing through the motor housing 40 flows through the air passageway 68 and into the combustion chamber 34 through the main combustion chamber inlet 76. The secondary combustion chamber inlet 78 is open to and communicates with the vestibule chamber interior 66. Because the combustion chamber 34 has a plurality of inlets that communicate with both the motor housing 40 and the vestibule chamber interior 66, a first portion 80 of the flow of air 28 being drawn into the furnace 20 by the fan 30 will flow from the vestibule chamber interior 66 and into the motor housing 40 and through the air passageway 68 and then enter the combustion chamber 34 through the main combustion chamber inlet 76. A second portion 82 of the flow of air 28 being drawn into the furnace 20 by the fan 30 will flow from the vestibule chamber interior 66 directly into the combustion chamber 34 through the secondary combustion chamber inlet 78. The first and second portions 80, 82 join together in the combustion chamber 34 and are drawn through the rest of the furnace 20 as described above. Because the flow of air 24 being drawn into the furnace 20 by the fan 30 will follow the path of least resistance, the resistance encountered by the first and second portions 80, 82 of the flow of air 28 must be designed and balanced so that a sufficient amount of air flows through the motor housing 40 to cool the motor 32. The resistance to the first portion 80 of the air flow 28 is determined generally by the number, size, location and spacing of the plurality of motor housing inlets 70 and the spacing and restrictions experienced between the motor housing 40 and the motor 32 and any obstructions encountered within the air passageway 68 prior to flowing into the combustion chamber 34. The resistance encountered by the second portion 82 of the air flow 28 is generally determined by the size, dimension and location of the secondary combustion chamber inlet 78. While the secondary combustion chamber inlet 78 has been shown as being a single inlet, it should be understood that the secondary combustion chamber inlet 78 can be one of a plurality of secondary combustion chamber inlets without departing from the scope of the invention as defined by the claims.

Figure 2A:
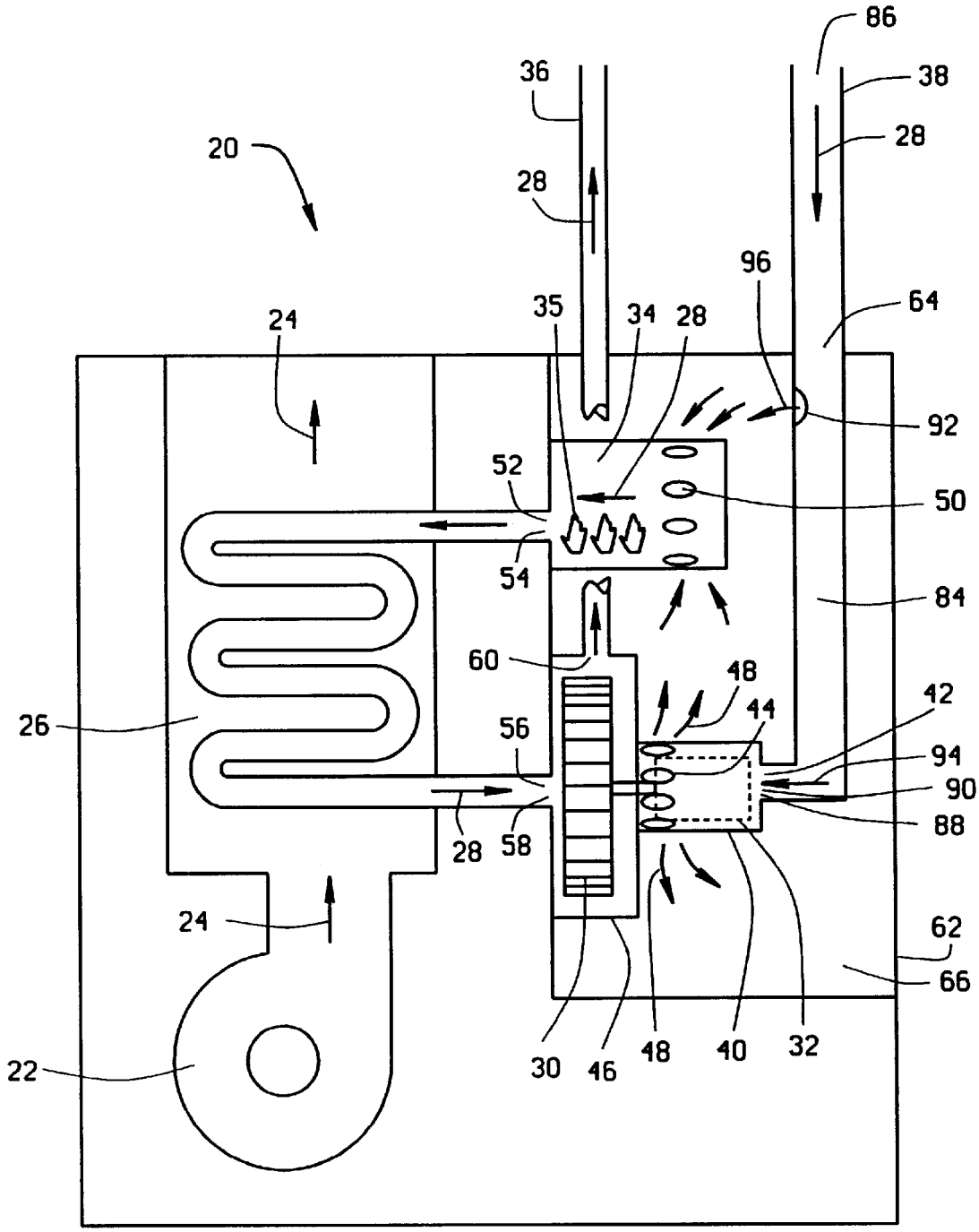
FIG. 2A is a schematic drawing of a traditional furnace employing an alternative embodiment of the present invention to cool the motor that drives the fan.

In an alternate embodiment, as shown in FIGS. 2A and B, the at least one vestibule chamber inlet 64 is connected to and communicates with the at least one motor housing inlet 42 by an air passageway 84 having at least one inlet 86 and at least one outlet 88. The air passageway 84 causes the flow of air 48 through the motor housing 40 to originate outside of the vestibule chamber 62 and flow through the at least one vestibule chamber inlet 64 and the at least one air passageway inlet 86 prior to entering the motor housing 40. The at least one air passageway outlet 88 is connected to the at least one motor housing inlet 42 and the flow of air 48 flowing through the motor housing 40 flows from the air passageway 84 through the at least one air passageway outlet 88 and into the motor housing 40 through the at least one motor housing inlet 42. The flow of air 48 then exits the motor housing 40 through the at least one motor housing outlet 44 and flows into the vestibule chamber interior 66. The vestibule chamber interior 66 is operatively connected to and communicates with the at least one combustion chamber inlet 50 so that the flow of air 48 exiting the motor housing 40 and entering the vestibule chamber interior 66 flows through the vestibule chamber interior 66 and then into the combustion chamber 34 through the at least one combustion chamber inlet 50. Preferably, the vestibule chamber 62 is sealed so that the entire flow of air 28 being drawn into the furnace 20 by the fan 30 flows through the at least one vestibule chamber inlet 64 and through the air passageway 84. Because the vestibule chamber 62 is sealed, all air flowing through the vestibule chamber interior 66 flows into the combustion chamber 34 through the at least one combustion chamber inlet 50.

In one aspect of the alternate embodiment, as can be seen in FIG. 2A, the at least one air passageway outlet 88 is one of a plurality of air passageway outlets. The air passageway 84 has a primary air passageway outlet 90 and at least one secondary air passageway outlet 92. The primary air passageway outlet 90 is connected to the at least one motor housing inlet 42 and the at least one secondary air passageway outlet 92 is open to the vestibule chamber interior 66. Because the air passageway 84 has a plurality of outlets, the flow of air 28 being drawn into the furnace 20 by the fan 30 will be split into a plurality of flows of air. A first portion 94 of the flow of air 28 will be channeled through the air passageway 84 and into the motor housing 40 through the primary air passageway outlet 90. The first portion 94 of the flow of air 28 is the same as the flow of air 48 flowing through the motor housing 40. The first portion 94 of the flow of air 28 exits the motor housing 40 through the at least one motor housing outlet 44 and flows into the vestibule chamber interior 66. A second portion 96 of the flow of air 28 will be channeled through the air passageway 84 and into the vestibule chamber interior 66 through the at least one secondary air passageway outlet 92. Because the vestibule chamber 62 is sealed the first and second portions 94, 96 of the flow of air 28 can mix together in the vestibule chamber interior 66 and are both drawn into the combustion chamber 34 through the at least one combustion chamber inlet 50. The first and second portions 94,96 then flow through the heat exchanger 42 and the fan housing 46 and are exhausted from the furnace 20 through the exhaust pipe 36.

When the air passageway 84 has both a primary air outlet 90 and at least one secondary air passage outlet 92, the flow of air 28 being drawn into the furnace 20 by the fan 30 will follow the path of least resistance when being drawn into the combustion chamber 34. Therefore, the resistance experienced by the first portion 94 of the flow of air 28 and the second portion 96 of the flow of air 28 must be designed and balanced to ensure that the first portion 94 of the flow of air 28 which flows through the motor housing 40 is adequate to cool the motor 32. As was discussed above, the general factors that effect the resistance experienced by the first and second portions 94, 96 of the flow of air 28 include the size, location and obstructions experienced by both the first and second portions 94, 96 of the flow of air 28 as they follow their respective flow paths.

Figure 2B:
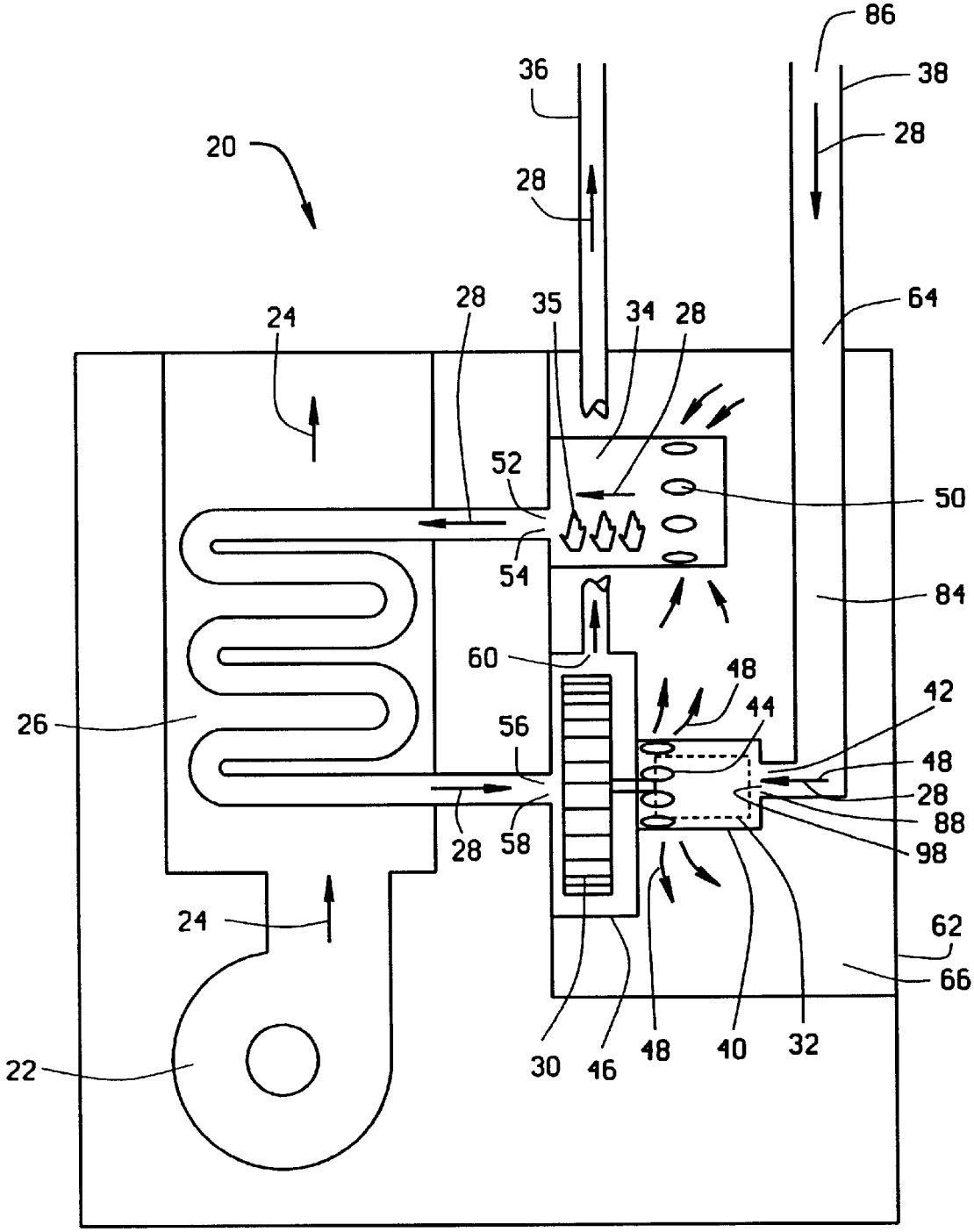
FIG. 2B is a schematic drawing of the furnace of FIG. 2A wherein the air passageway has a single outlet.

In another aspect of the alternate embodiment, as can be seen in FIG. 2B, the at least one air passageway outlet 88 is a single air passageway outlet 98 and is connected to the at least one motor housing inlet 42. The air passageway 84 channels the flow of air 28 being drawn into the furnace 20 by the fan 30 through the single air passageway outlet 98 and into the motor housing 40 through the at least one motor housing inlet 42. The entire flow of air 28 through the furnace flows through the motor housing 40. A maximum amount of air flows through the motor housing 40 to cool the motor 32 and a maximum amount of cooling occurs.

Figure 3:
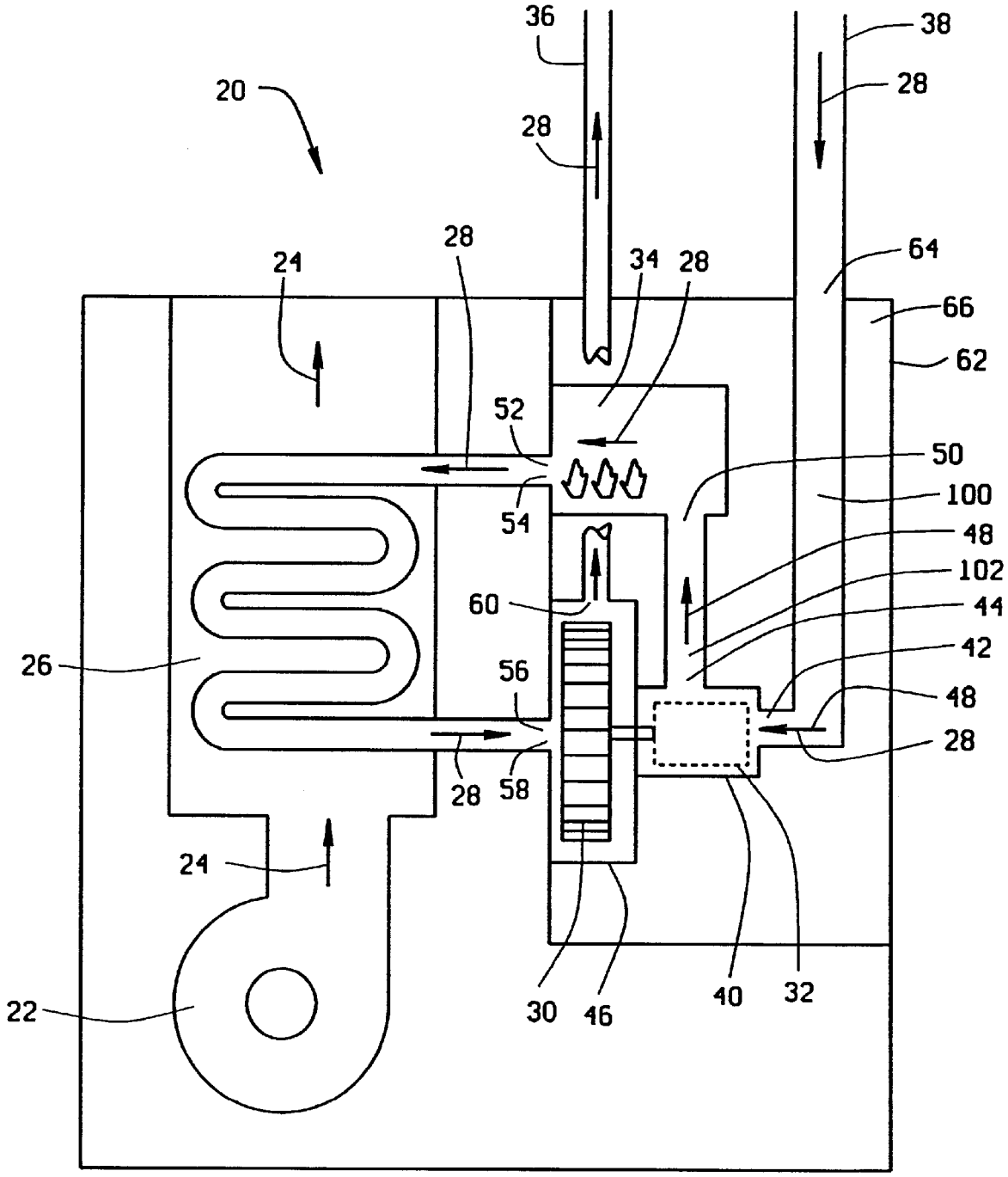
FIG. 3 is a schematic drawing of another embodiment of the furnace.

In yet another alternate embodiment, as can be seen in FIG. 3, the at least one vestibule chamber inlet 64 is connected to the at least one motor housing inlet 42 by a first air passageway 100. The first air passageway 100 causes the flow of air 28 being drawn into the furnace 20 by the fan 30 to originate outside of the vestibule chamber 62 and flow through the at least one vestibule chamber inlet 64, through the first air passageway 100, and into the motor housing 40 through the at least one motor housing inlet 42. The at least one motor housing outlet 44 is connected to the at least one combustion chamber inlet 50 by a second air passageway 102. The second air passageway 102 causes the flow of air 28 to flow from the motor housing 40, through the at least one motor housing outlet 44, through the second air passageway 102 and into the combustion chamber 34 through the at least one combustion chamber inlet 50. The flow of air 28 then flows through the heat exchanger 28, through the fan housing 46 and exits the furnace 20 through the exhaust pipe 36.

Figure 4:
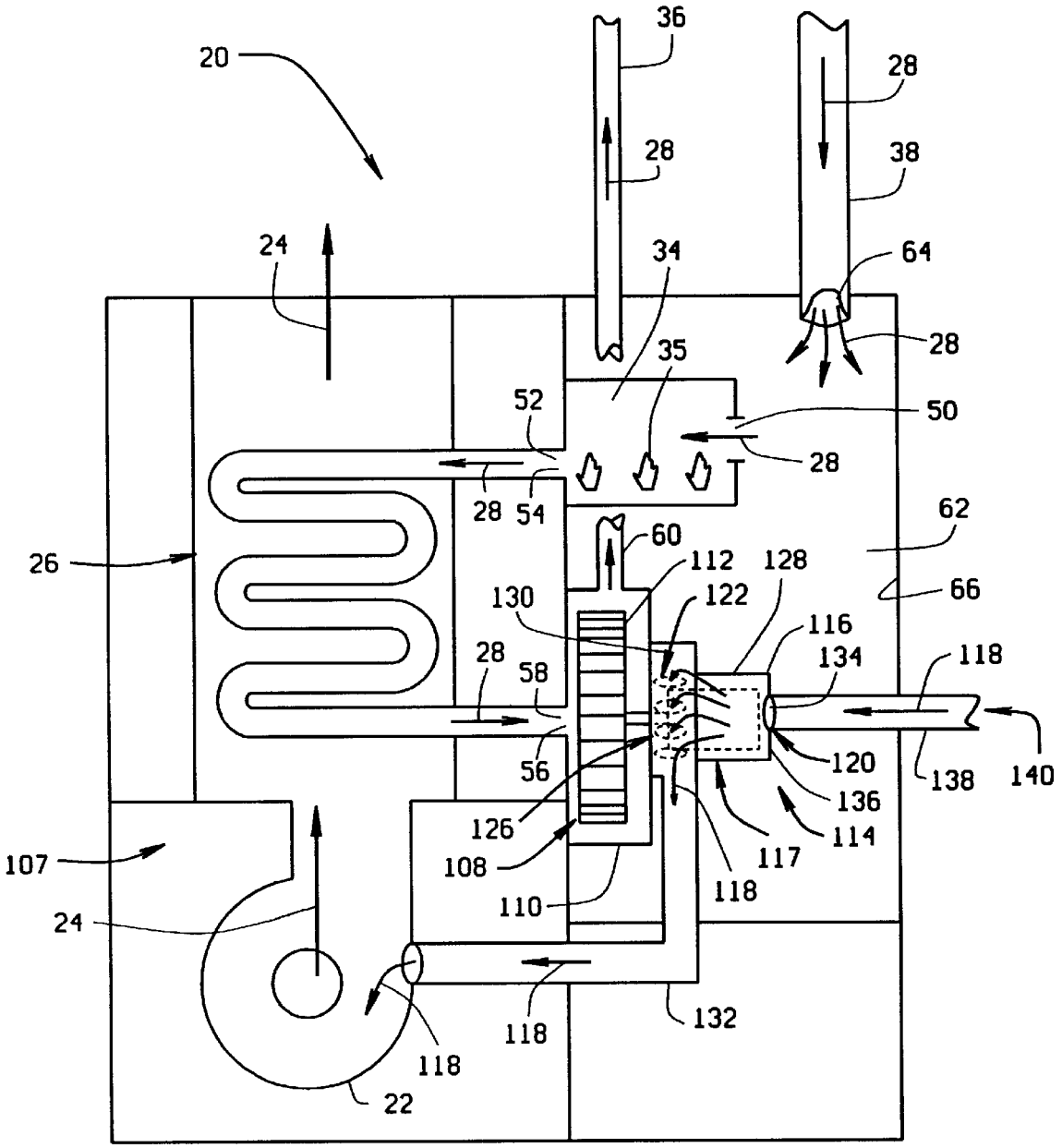
FIG. 4 is a schematic drawing of an alternate embodiment of the furnace of the present invention where cooling air is drawn across the inducer motor by operation of a main blower of the furnace.

In yet another alternate embodiment of the invention, as can be seen in FIG. 4, the general arrangement of the furnace 20 is as previously described. The furnace 20 has the main blower 22 housed in an inlet plenum 107 where the main blower 22 draws temperature controlled air 24 from the exterior environment such as from the cold air return ducts in a house, and pressurizes the temperature controlled air 24 to flow over a heat exchanger 26 where the temperature controlled 24 air is heated and directed into the supply ducts for the house. The furnace 20 also has an inducer fan 108 that draws the combustion air 28 into the vestibule 62 of the furnace 20. After entering the vestibule 62, the combustion air 28 enters the combustion chamber 34, flows through the burners 35, flows through the heat exchanger 26 to heat the temperature controlled air 24, and flows out of the furnace 20 through the exhaust pipe 36.

As stated previously, the inducer fan 108 has a fan housing 110 and an impeller 112 rotatably disposed within the fan housing 110 for drawing or inducing a flow of the combustion air 28 into the combustion chamber 34. The impeller 112 is operably driven by an inducer fan motor 114 mounted on the inducer fan housing 110. The motor 114 has a motor housing 116 that defines a hollow interior 117 of the motor housing that surrounds the motor 114. The motor 114 and motor housing 116 are preferably positioned in the vestibule 62 with the inducer fan 108. In the embodiment of the invention shown in FIG. 4, the motor housing 116 is separated from the inducer fan housing 110 such that the combustion air 24 that flows through the inducer fan housing 110 does not enter the motor housing 116. In contrast to the embodiments of the invention previously shown, in FIG. 4, the cooling air 118 for the inducer fan motor 114 is supplied by the operation of the main blower 22.

The inducer fan motor housing 116 is provided with an inlet opening 120 and an outlet opening 122 that communicate with the motor housing interior 117. The motor housing outlet 122 includes a plurality of holes 126 circumferentialy spaced about a cylindrical exterior surface 128 of the inducer fan motor housing 116. An annular manifold 130 extends around the cylindrical exterior surface 128 of the motor housing 116 and around the circumferentialy spaced holes 126. Preferably, an outlet pipe 132 extends between the manifold 130 surrounding the motor housing outlet 122 and the inlet plenum 107. The motor housing inlet 120 is formed as a plurality of holes 134 through an axial end 136 of the motor housing 116. The motor housing inlet 120 may also be formed in a similar fashion to the outlet 122 with a plurality of holes 134 circumferentialy spaced about the motor housing exterior surface 128 and an inlet manifold extending over the inlet holes 134. The motor housing inlet 120 is provided with an inlet pipe 138 extending from the inlet 120 to a cooling air source 140. As shown in FIG. 4, the inlet pipe 138 is directed from the inlet 120 to the external environment outside the furnace 20 and the furnace vestibule 62 so that the cooling air flow 118 does not interfere with the operation of the inducer fan 108 and its circulation of combustion gases 28 through the vestibule 62. The inlet 120 and outlet 122 are arranged on axially opposite sides of the motor housing 116 and at a distance apart so that the cooling air 118 may be drawn axially across the motor 114 to cool bearings and other motor components located within the motor housing interior 117.

In operation, the main blower 22 draws temperature controlled air into the inlet plenum 107. From the inlet plenum 107, the temperature controlled air 24 is pressurized by the main blower 22 and directed over the heat exchanger 26 where it is heated and returned to the external environment. When the main blower 22 is energized, the suction forces created by the main blower 22 draw cooling air 108 from the cooling air source 140 (the furnace external environment) into the inlet pipe 138, through the motor housing inlet 120, and into the motor housing interior 117. Inside the motor housing interior 117, the cooling air flows over the motor components to the outlet 122 cooling the motor 114 and its components. The suction forces created by the main blower 22 draw the cooling air 118 from the outlet 122 into the outlet pipe 132 where the cooling air 118 is directed to the inlet plenum 107 and the suction of the main blower 22. The motor housing 116, the manifold 130, the outlet pipe 132 and the inlet pipe 138 are sealed together to avoid any combustion exhaust of the furnace being drawn into the main blower 22. In this arrangement, the cooling air 118 that was drawn over the motor 114 is mixed with the temperature controlled air 24 in the inlet plenum 107 before the mixture is directed to flow over the heat exchanger 36. Thus, a portion of the temperature controlled air 24 that is circulated through the furnace 20 includes the cooling air 118 drawn through the motor housing interior 117.

While the present invention has been described by reference to specific embodiments, it should be understood that modifications and variations of the invention may be constructed without departing from the scope of the invention as defined by the following claims.

What is claimed is:

1. A furnace comprising:

an inducer fan for circulating combustion gases through the furnace;

an inducer motor in an inducer motor housing, the inducer motor driving the inducer fan;

a blower fan for circulating temperature controlled air through the furnace; and an inlet plenum of the furnace containing the blower fan, the inlet plenum communicating with the inducer motor housing whereby operation of the blower fan draws cooling air into the inducer motor housing to cool the inducer motor.

2. The furnace of claim 1, wherein:

the inducer motor housing is in direct communication with the inlet plenum whereby cooling air drawn over the motor is directed to and mixed in the inlet plenum with the temperature controlled air and circulated through the furnace by the main blower fan.

3. The furnace of claim 1, wherein:

the inducer motor housing defines a hollow interior around the motor, the motor housing has at least one inlet hole and at least one outlet hole through to the hollow interior, and the outlet hole is in communication with the furnace inlet plenum.

4. The furnace of claim 3, wherein:

an inlet pipe is connected to the inducer motor housing at the inlet hole and an outlet pipe is connected to the inducer motor housing at the outlet hole, the inlet pipe directs cooling air into the interior of the inducer motor housing and the outlet pipe directs cooling air from the interior of the inducer motor housing to the inlet plenum.

5. The furnace of claim 4, wherein:

the inlet pipe draws the cooling air from outside the furnace.

6. The furnace of claim 5, wherein:

the inducer fan and inducer motor are housed in a vestibule that is partitioned from the inlet plenum of the furnace and the inlet pipe draws cooling air from outside the vestibule.

7. The furnace of claim 4, wherein:

the inducer motor housing is spaced from the blower fan by the outlet pipe.

8. A furnace comprising:

an inducer fan for circulating combustion gases through the furnace;

an inducer motor in an inducer motor housing having a hollow interior surrounding the inducer motor; and a blower fan of the furnace housed in an inlet plenum of the furnace, the inlet plenum being in communication with the interior of the inducer motor housing, the blower fan drawing cooling air into the interior of the inducer motor housing when the blower fan is operated.

9. The furnace of claim 8, wherein:

the blower fan circulates temperature controlled air through the furnace and a portion of the temperature controlled air is cooling air drawn through the interior of the inducer motor housing.

10. The furnace of claim 9, wherein:

the inducer motor housing is in direct communication with the inlet plenum whereby temperature controlled air and cooling air are mixed in the inlet plenum.

11. The furnace of claim 8, wherein;

the inducer motor housing has inlet and outlet holes that communicate with the interior of the inducer motor housing, the outlet hole is in communication with the inlet plenum whereby operation of the blower fan draws cooling air through the inlet hole into the interior of the inducer motor housing and out of the outlet hole into the inlet plenum.

12. The furnace of claim 11, wherein:

the inducer motor housing has an inlet pipe connected at the inlet hole and an outlet pipe connected at the outlet hole, the outlet pipe extends between the inducer motor housing and the inlet plenum such that operation of the blower fan draws the cooling air through the inlet pipe, then through the inducer motor housing interior and then through the outlet pipe into the inlet plenum.

13. The furnace of claim 12, wherein:

the inducer motor housing is housed in a vestibule of the furnace that is partitioned from the inlet plenum and the inlet pipe extends from outside the furnace vestibule to the inlet hole of the inducer motor housing.

14. The furnace of claim 8, wherein:

the furnace is a high-efficiency furnace.

15. A method of cooling an inducer fan motor in a furnace, wherein the furnace has a main blower fan housed in an inlet plenum that circulates temperature controlled air through the furnace and an inducer fan that circulates combustion gases through the furnace, the inducer fan is driven by the inducer fan motor, the inducer fan motor has a motor housing defining a hollow interior that surrounds the inducer fan motor, the method of cooling the inducer fan motor comprising the steps of:

providing the motor housing with an inlet and an outlet into the hollow interior of the motor housing;

communicating the outlet with the inlet plenum;

communicating the inlet with a cooling air source; and operating the main blower fan so as to draw cooling air from the cooling air source into the inlet, then through the hollow interior of the motor housing and then through the outlet into the inlet plenum.

16. The method of claim 15, wherein:

operating the main blower fan to draw cooling air into the inlet, then through the hollow interior of the motor housing and then through the outlet into the inlet plenum mixes the cooling air with the temperature controlled air in the furnace inlet plenum.

17. The method of claim 16, wherein:

mixing the cooling air with temperature controlled air heats the temperature controlled air before the temperature controlled air passes through the furnace.

18. The method of claim 15, wherein;

communicating the outlet with the inlet plenum includes connecting an outlet pipe to extend between the motor housing outlet and the inlet plenum.

19. The method of claim 15, wherein;

communicating the outlet with the inlet plenum includes providing at least one hole through the motor housing that communicates with the inlet plenum.

20. The method of claim 15, wherein:

communicating the inlet with the cooling air source includes connecting an inlet pipe to extend between the motor housing inlet and an exterior environment of the furnace.

* * * * *